US009161405B2

(12) United States Patent
Sakai

(10) Patent No.: US 9,161,405 B2
(45) Date of Patent: Oct. 13, 2015

(54) LIGHT EMITTING DIODE DRIVING CIRCUIT AND SYSTEM

(75) Inventor: Koichi Sakai, Kawagoe (JP)

(73) Assignee: PRINCETON TECHNOLOGY CORPORATION, New Taipei (TW)

( * ) Notice: Subject to any disclaimer, the term of this patent is extended or adjusted under 35 U.S.C. 154(b) by 906 days.

(21) Appl. No.: 13/357,395

(22) Filed: Jan. 24, 2012

(65) Prior Publication Data

US 2012/0187855 A1 Jul. 26, 2012

(30) Foreign Application Priority Data

Jan. 24, 2011 (TW) ..... 100102472 A

(51) Int. Cl.
*H05B 37/00* (2006.01)
*H05B 33/08* (2006.01)

(52) U.S. Cl.
CPC ..... *H05B 33/0827* (2013.01)

(58) Field of Classification Search
CPC .... H05B 33/0827; H05B 37/00; H05B 39/04; H05B 41/28
USPC ..... 315/121, 161, 192, 291, 185 R, 185 S, 315/224, 307, 308
See application file for complete search history.

(56) References Cited

U.S. PATENT DOCUMENTS

| | | | | |
|---|---|---|---|---|
| 7,928,856 | B2 * | 4/2011 | Jacubovski et al. | 340/653 |
| 8,461,769 | B2 | 6/2013 | Shiu et al. | |
| 8,618,745 | B2 * | 12/2013 | Tsuchida et al. | 315/294 |
| 8,742,689 | B2 * | 6/2014 | Chu | 315/299 |
| 2008/0068298 | A1 | 3/2008 | Shen et al. | |
| 2008/0174929 | A1 * | 7/2008 | Shen et al. | 315/307 |
| 2009/0289559 | A1 | 11/2009 | Tanaka et al. | |
| 2010/0259185 | A1 | 10/2010 | Sadwick et al. | |
| 2012/0049763 | A1 * | 3/2012 | Huang | 315/307 |

FOREIGN PATENT DOCUMENTS

| | | | |
|---|---|---|---|
| CN | 101207950 | A | 6/2008 |
| TW | 201002156 | A1 | 1/2010 |
| TW | 201043092 | A1 | 12/2010 |

OTHER PUBLICATIONS

Taiwan Office Action for Taiwan Application No. 100102472 dated Oct. 18, 2013.

* cited by examiner

*Primary Examiner* — Hai L Nguyen
(74) *Attorney, Agent, or Firm* — Muncy, Geissler, Olds & Lowe, P.C.

(57) ABSTRACT

A light emitting diode (LED) driving circuit is provided. The LED driving circuit includes: at least one LED driving module, coupled to the at least one LED series, for driving the corresponding LED series; and a voltage regulating module, coupled to the at least one LED driving module, for providing a regulation signal according to an output signal from the at least one LED driving module, wherein an input voltage of the at least one LED series is regulated according to the regulation signal.

10 Claims, 6 Drawing Sheets

LIGHT EMITTING DIODE DRIVING CIRCUIT AND SYSTEM

CROSS REFERENCE TO RELATED APPLICATIONS

This Non-provisional application claims priority under 35 U.S.C. §119(a) on Patent Application No(s). 100102472, filed in Taiwan, Republic of China on Jan. 24, 2011, the entire contents of which are hereby incorporated by reference.

BACKGROUND OF THE INVENTION

1. Field of the Invention

The present invention relates to light emitting diode (LED) driving technology, and in particular relates to voltage regulation technology for driving transistors in an LED circuit.

2. Description of the Related Art

Light Emitting diode (LED) driving chips are popularly used in display apparatuses such as LED televisions. FIG. 1 is a schematic diagram showing the LED driving chip in the prior art. The LED driving chip 110 comprises a plurality of LED driving modules 112. an LED series 130, having a plurality of LEDs connected in series and between a voltage source Vsupply and an LED driving module 112. The LED driving module 112 is used to drive the LED series 130.

Note that, in the prior art, a variable resistor Rad disposed between the voltage source Vsupply and the LED series 130 for adjusting the voltage drop across the LED driving module 112. Specifically, the components in FIG. 1 satisfy the following equation: Vsupply=ILED×Rad+VLEDs+V112, where "ILED" denotes the current across the LED 130 and "VLEDs" denotes the voltage across the LED 130. With a given specification for the LED 130, both of the values of "ILED" and "VLEDs" are constant. Therefore, when the value of the variable resistor Rad is calibrated, the voltage drop V112 across the LED driving module 112 will be accordingly calibrated.

However, the prior art fails to calibrate the voltage drop across the LED driving module 112 within a proper range automatically. Thus, the present invention provides a new circuit to solve this issue.

A detailed description is given in the following embodiments with reference to the accompanying drawings.

BRIEF SUMMARY OF THE INVENTION

The present invention can be more fully understood by reading the subsequent detailed description and examples with references made to the accompanying drawings, wherein:

The present invention provides a light emitting diode (LED) driving circuit. The LED driving circuit comprises: at least one LED driving module, coupled to the at least one LED series, for driving the corresponding LED series; and a voltage regulating module, coupled to the at least one LED driving module, for providing a regulation signal according to an output signal from the at least one LED driving module, wherein an input voltage of the at least one LED series is regulated according to the regulation signal.

The present invention also provides a light emitting diode (LED) driving and regulating system. The system comprises the LED driving module described above and a voltage source, providing a voltage to a plurality of LED series, and a plurality of LED driving modules, respectively, coupled to the plurality of the LED series, for driving the corresponding LED series, a controller, coupled to the voltage source, for sending a control signal to the voltage source to regulate the input voltage provided to the plurality of the LED series, wherein the plurality of the LED driving modules are coupled in series, and the LED driving modules of one stage receives and processes the output signal from the LED driving modules of a previous stage to provide an output signal, wherein the LED driving modules of the last stage sends its output signal to the controller for regulating the input voltage of the plurality of the LED series.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
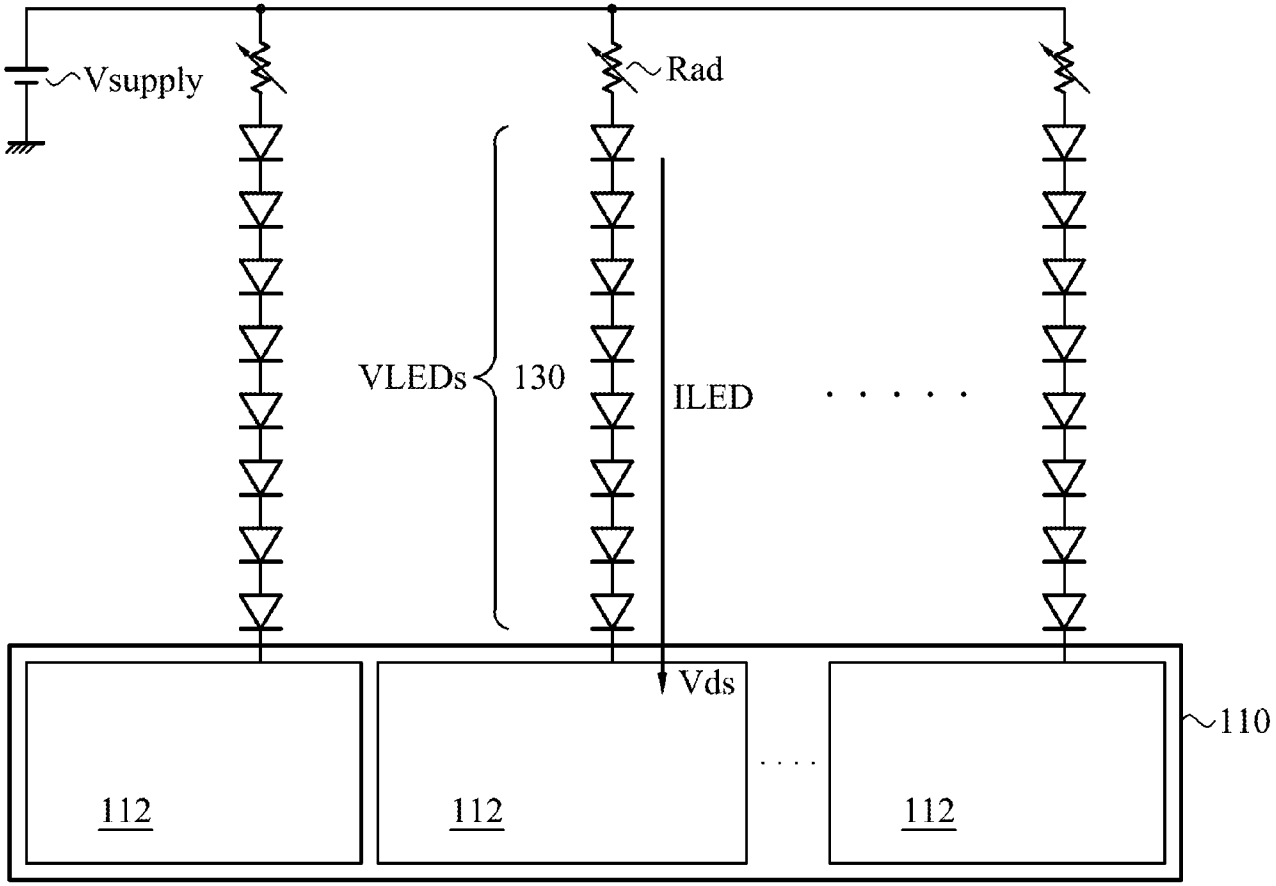
FIG. 1 ( PRIOR ART )
FIG. 1 is a schematic diagram showing the LED driving chip in the prior art.
Figure 2:
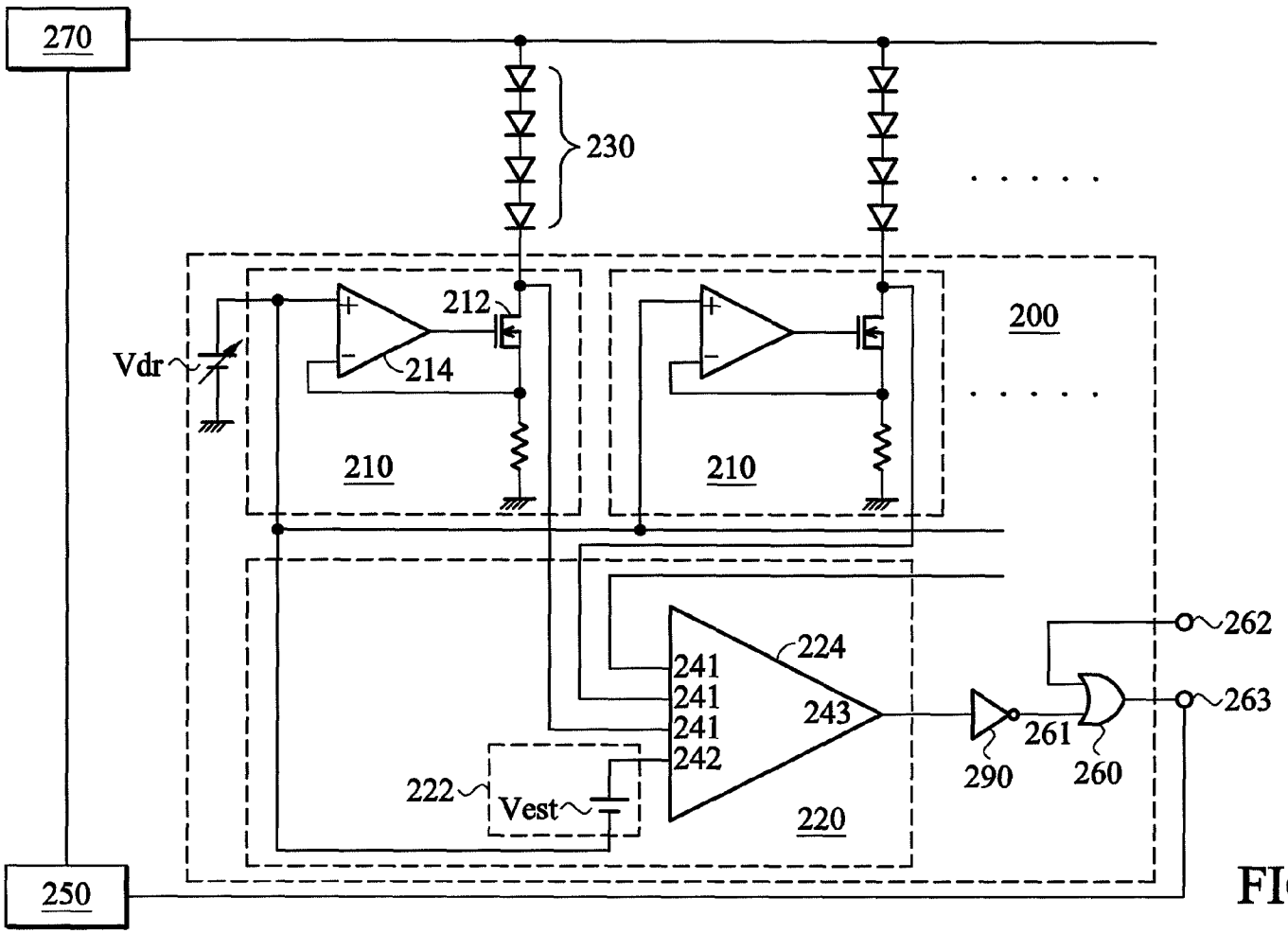
FIG. 2 is a schematic diagram of an LED driving circuit according to an embodiment of the present invention.

FIG. 2 is a schematic diagram of an LED driving circuit according to an embodiment of the present invention. The present invention achieves the purpose of automatically regulating the voltage of the LED driving circuit 200 by using feedback control. The LED driving circuit 200 comprises a plurality of LED driving modules 210 and a voltage regulating module 220. Each of the LED driving modules 210 comprises a driving transistor 212 and an operational amplifier 214, and the voltage regulating module 220 comprises a reference voltage generator 222 and a drain voltage comparator 224. Specifically, the principal of the present invention is to regulate the drain voltage of the driving transistor 212 so that the driving transistor 212 works in a saturation region. Through this manner, the current on the driven LED series 230 will be stable and make the LED series 230 emit light constantly. In addition, to improve the efficiency of the driving module, the drain voltage of the driving transistor 212 has to be controlled to not overgrow so as to prevent the LED driving circuit 200 from unnecessary power loss (the power loss equals to the drain voltage times the current of the driving transistor 212).

The components of the present invention will be further discussed in detail in the following paragraphs.

The driving transistor 212 of the present invention is used to drive a plurality of LEDs 230, wherein the plurality of LED are connected in series (so called LED series 230) and between a voltage source 270 and the LED driving module 210. The drain of the driving transistor 212 is connected to the LED series 230. The operational amplifier 214 of the present invention has an output end coupled to the gate of the driving transistor 212, and has an input end for receiving a driving voltage Vdr.

The reference voltage generator 222 in the voltage regulating module 220 is used to generate a reference voltage, which is used for comparison with the drain voltage of the driving transistor 212. In the embodiment of FIG. 2, the reference voltage generator 222 is coupled to the positive input end of the operational amplifier 214. The reference voltage generator 222 receives the driving voltage Vdr (which slightly equals to the drain voltage of the driving transistor 212) and then adds a voltage difference Vest to the driving voltage Vdr to generate a reference voltage which equals to the ideal drain voltage of the driving transistor 212.

Figure 3:
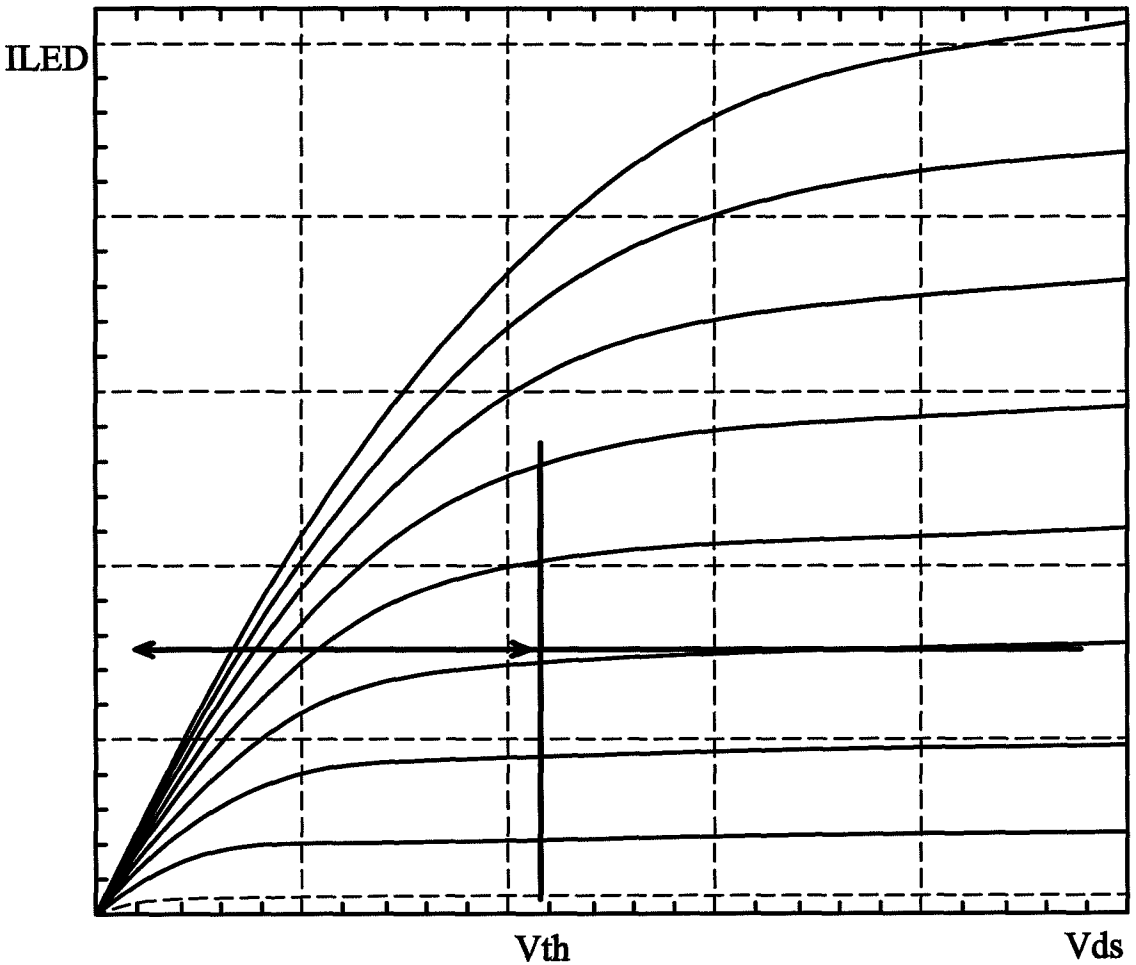
FIG. 3 shows the characteristic curve of the driving transistor 212 for illustrating the ideal drain voltage of the driving transistor 212.

FIG. 3 shows the characteristic curve of the driving transistor 212 for illustrating the ideal drain voltage of the driving transistor 212. The ideal drain voltage should be slightly greater than the lowest drain voltage Vth which makes the driving transistor 212 enter the saturation region so that the driving transistor 212 can have a stable current and the lowest power loss at the same time. Therefore, in an embodiment, if the reference voltage is the lowest drain voltage Vth, the voltage difference Vest should be set to be Vth−Vdr.

The drain voltage comparator 224 of the voltage regulating module is a multi-input comparator, which comprises a plurality of drain voltage input ends 241, a reference voltage input end 242, and a regulation signal output end 243. Each drain voltage input end 241 of the drain voltage comparator 224 is coupled to and obtains an output signal (drain voltage) from the drain of a driving transistor 212 of one of the LED driving modules 210. The reference voltage input end 242 of the drain voltage comparator 224 is coupled to the reference voltage generator 222 for receiving a reference voltage from the reference voltage generator 222.

The drain voltage comparator 224 of the present invention can compare the drain voltage received by the drain voltage input end 241 with the reference voltage received by the reference voltage input end 242 and generate a regulation signal (the comparison result) to an external controller 250. Then, the controller 250 regulates the voltage that the voltage source 270 provides to the LED 230 according to the regulation signal, and finally regulates the drain voltage Vds of the driving transistor 212. For example, when a drain voltage of one of the driving transistors 212 is lower than the reference voltage (too low), the LED series 230 connected to this driving transistor will operate in an unstable state. On one hand, when detecting that the drain voltage Vds is too low, the drain voltage comparator 224 sends a regulation signal to the controller 250, and the controller 250 regulates the output voltage of the voltage source 270 according to the regulation signal to make sure that all of the driving transistors 212 operate in the saturation region. On the other hand, when the drain voltage of the driving transistors 212 are all higher than the reference voltage (too high), the controller 250 reduces the voltage provided by the voltage source 270 and thus lowers the drain voltage Vds of all of the driving transistors 212 for limiting the power loss.

Figure 4A:
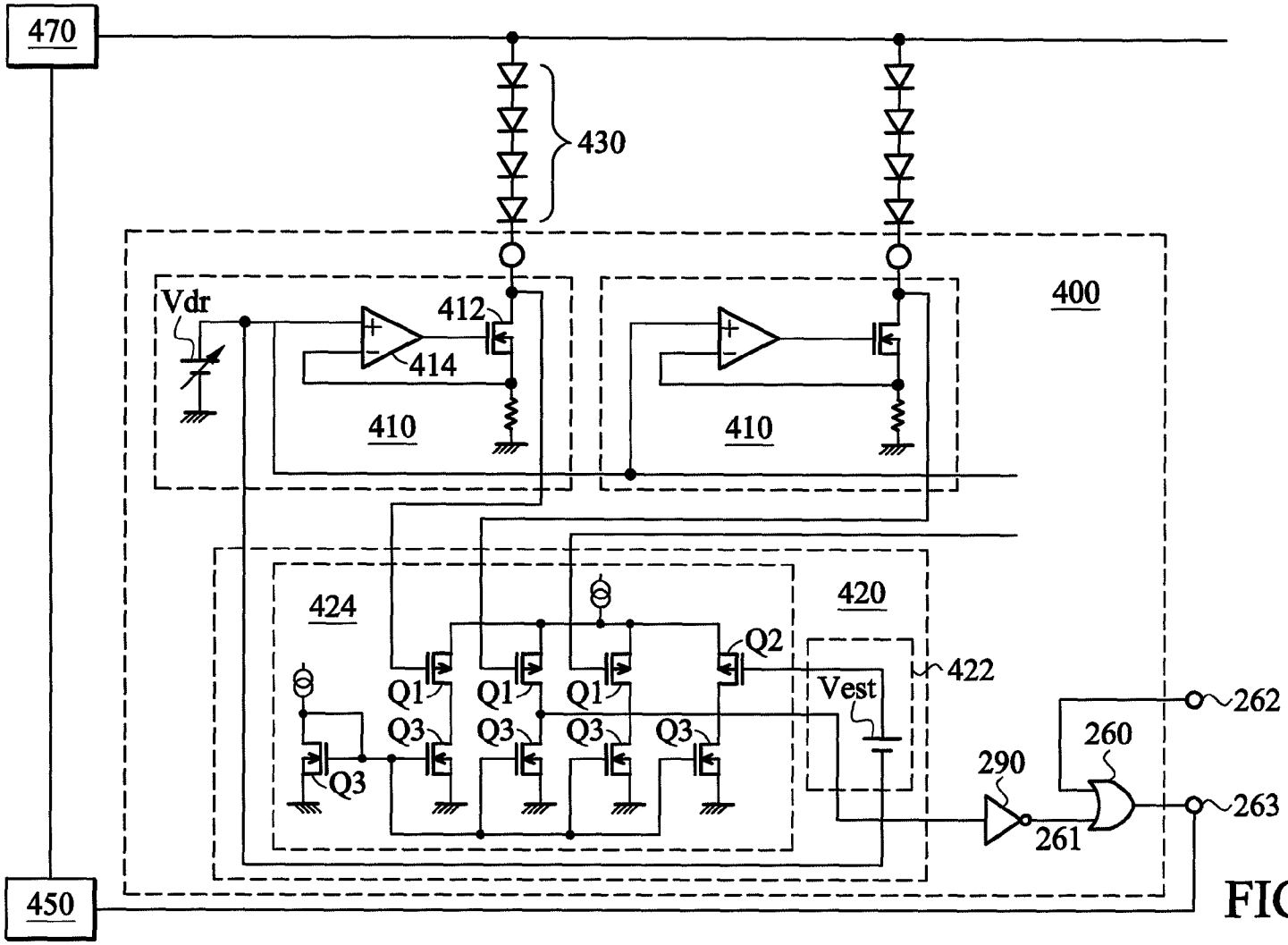
FIG. 4A is a schematic diagram of an LED driving circuit according to another embodiment of the present invention.

FIG. 4A is a schematic diagram of an LED driving circuit according to another embodiment of the present invention. Similar to the LED driving circuit 200, the LED driving circuit 400 in FIG. 4A comprises a plurality of LED driving modules 410 and a voltage regulating module 420. Each of the LED driving modules 410 is used to drive the LED series 430, and comprises a driving transistor 412 and an operational amplifier 414. The voltage regulating module 420 comprises a reference voltage generator 422 and a drain voltage comparator 424. In the drain voltage comparator 424 of FIG. 4A, the drain voltage comparator 224 of the voltage regulating module 220 in FIG. 2 is replaced by a combination of transistors Q1, Q2 and Q3, where the transistors Q1, Q2 and Q3 form a plurality of current mirrors. Each drain voltage is inputted to the gate of the first transistor Q1, and the reference voltage Vest generated by the reference voltage generator 422 is coupled to the gate of the second transistor Q2. In addition, the regulation signal is the voltage of the source of the first transistor Q1, which will be inputted to an external controller 450. The controller 450 regulates the voltage that the voltage source 470 provided to the LED 430 according to the regulation signal, thus regulating the drain voltage Vds of the driving transistor 412.

Figure 4B:
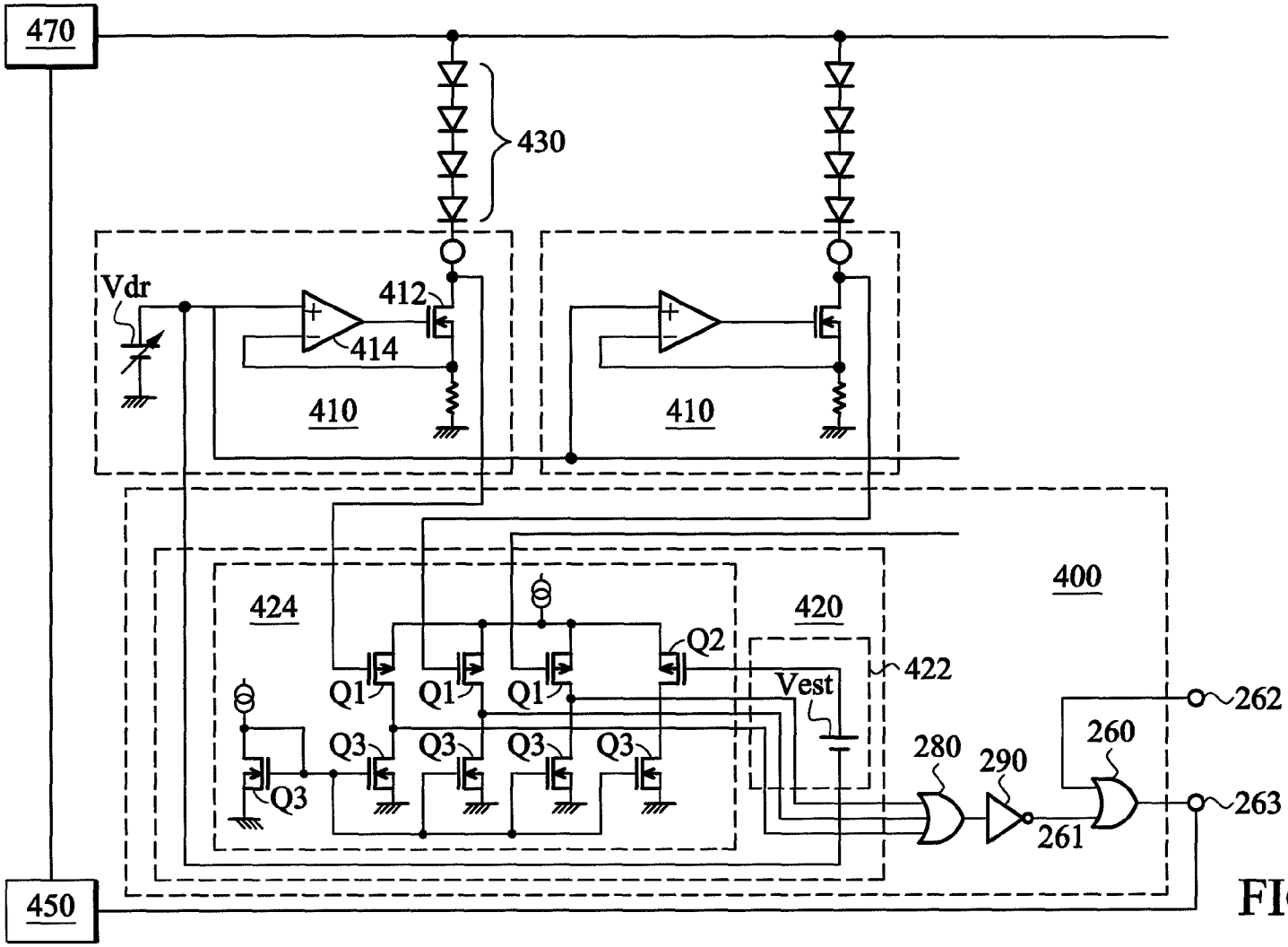
FIG. 4B is a schematic diagram of the LED driving circuit according to yet another embodiment of the present invention.

FIG. 4B is a schematic diagram of the LED driving circuit according to yet another embodiment of the present invention. Similar to the LED driving circuit 200 in FIG. 2, the LED driving circuit 400 in FIG. 4B comprises a plurality of LED driving modules 410 and a voltage regulating module 420. Each of the LED driving modules 410 is used to drive the LED series 430, and comprises a driving transistor 412 and an operational amplifier 414. The voltage regulating module 420 comprises a reference voltage generator 422 and a drain voltage comparator 424. In the drain voltage comparator 424 of FIG. 4A, the drain voltage comparator 224 of the voltage regulating module 220 is replaced by a combination of transistors Q1, Q2 and Q3, where the transistors Q1, Q2 and Q3 form a plurality of current mirrors. The difference between embodiments in FIG. 4A and FIG. 4*b* is that the regulation signal in FIG. 4A is the source voltage of the first transistor Q1 while the regulation signal in FIG. 4B is the output of an OR gate 280. The OR gate 280 in FIG. 4B comprises a plurality of input ends, respectively coupled to a drain of a first transistor Q1 for inputting the drain voltage of the first transistor Q1.

In FIG. 2, FIG. 4A, and FIG. 4B, the present invention further comprises an inverter 290, which is coupled to the regulation signal for inverting the regulation signal. When the drain of the driving transistor 212/412 of the LED driving module 200/400 is higher than the reference voltage, the regulation signal is at a high level (H) and the output of the inverter 290 is at a low level (L); alternatively, when the drain of the driving transistor 212/412 of the LED driving module 200/400 is lower than the reference voltage, the regulation signal is at a low level (L) and the output of the inverter 290 is at a high level (H).

Figure 5:
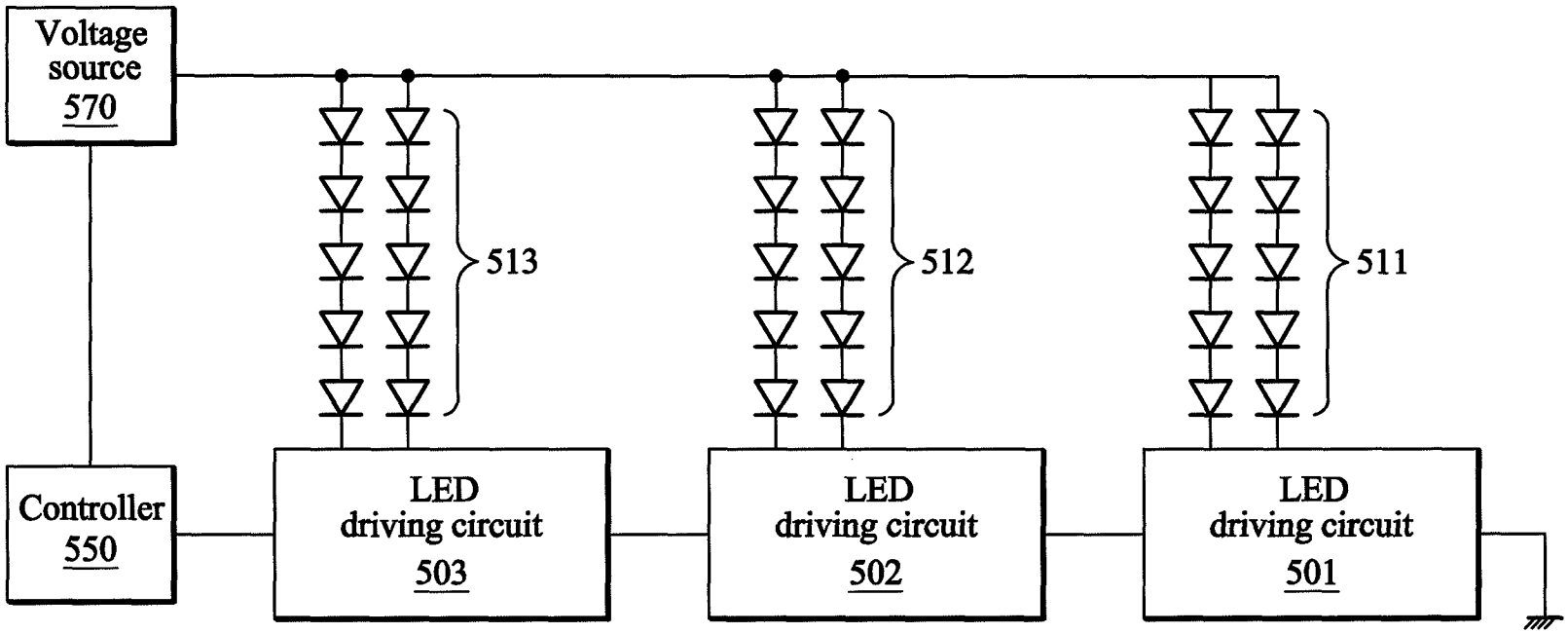
FIG. 5 is a schematic diagram of the LED driving system 500 of the present invention.

The present invention further provides an LED driving and regulating system, which uses feedback control to achieve the purpose of regulating the voltage. FIG. 5 is a schematic diagram of the LED driving system 500 of the present invention. The LED driving and regulating system of the present invention comprises stages of LED driving modules 501~503, a voltage source 570 and a controller 550. Each stage of the LED driving circuits 501~503 can respectively drive and regulate the LED series 511~513. The LED driving circuit 501~503, for example, may be the LED driving module 200 of FIG. 2. Since the LED driving module 200 has been fully discussed previously, the detailed structure of the LED driving circuits 501~503 will not be further described. In the present system, the voltage source 570 is used to provide a voltage, and the controller 570 is used to output a control signal to the voltage source 50 according to the regulation signal to regulate the input voltage of the LED series 511~513. In general, the LED driving circuits of the present invention can be respectively used in display chips. A single LED driving circuit can be used to control several LED series, but the number of the LED series has a limit. Therefore, for controlling a display which has a huge amount of LED series (for example, over 16 LED series), a plurality of LED driving circuits, as shown in FIG. 5, are required.

Please refer to FIG. 2, FIG. 4A, FIG. 4B, and FIG. 5. In a better embodiment, the voltage regulating module further comprises a double input OR gate 260, which has a first input end 261 coupled to the output of the inverter 290 of the voltage regulating module, a second input end 262 coupled to the output of the double input OR gate of the voltage regulating module of the LED driving circuit of a previous state (not shown in these Figs.), and an output end 263 coupled to the input of the double input OR gate of the voltage regulating module of the LED driving circuit of a previous state of a next LED driving circuit (not shown in these Figs.) or the controller.

The LED driving circuits 501~503 in FIG. 5 are connected in series, where one of the LED driving circuit receives an output signal from the LED driving circuit of a previous state, and processes the signal with the logical unit 260 and 290 and then outputs the signal, and the LED driving circuit of the last stage sends the output signal to the controller 550 for regulating all of the input voltages of the LEDs 511~513. For example, the output of the double input OR gate of the LED driving circuit 502 in FIG. 5 is coupled to the LED driving circuit 503 of a next stage, and the output of the double input OR gate of the LED driving circuit 503 is coupled to the controller 550. In this embodiment, when the driving transistors of the LED driving circuits 501~503 of every stage all enter the saturation region, the drain voltage comparator of each stage will output a high signal (H). The high signal is then inverted to a low signal (L) so that the double input OR gate of the LED driving circuit 503 of the last stage outputs a low signal, and thus the controller 550 lowers the output of the voltage source 570 to reduce the power loss of the driving transistors in each stage. On the contrary, when a driving transistor of an LED driving circuit of one stage does not operate in the saturation region, the drain voltage comparator in that stage will output a low signal. The low signal is then inverted to be a high signal so that the LED driving circuit 503 of the last stage outputs a high signal, and thus the controller 550 raises the voltage provided by the voltage source 570 to make sure that all of the driving transistors in every stage will be in saturation state. In an embodiment, the voltage source 570 is a DC to DC voltage converter, but the present invention should not be limited thereto.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A light emitting diode (LED) driving circuit, comprising:

at least two LED driving modules, each of the at least two LED driving modules is arranged to drive a corresponding LED series of at least two LED series, wherein the each of the at least two LED driving modules comprises:

a driving transistor having a drain connected to a first end of the corresponding LED series; and an operational amplifier comprising a negative input end connected to a source of the driving transistor and a positive input end coupled to a driving voltage, wherein a second end of the corresponding LED series is provided with a first voltage from a voltage source, and the positive input ends of the operational amplifiers of the at least two LED driving modules are connected to the driving voltage together; and a voltage regulating module, coupled to the at least two LED driving modules, for providing a regulation signal to a controller according to drain voltages at the drains of the driving transistors in the at least two LED driving modules.

2. The LED driving circuit as claimed in claim 1, wherein the voltage regulating module includes a reference voltage generator for generating a reference voltage, and a drain voltage comparator;

wherein the drain voltage comparator comprises:

(i) at least two drain voltage input ends coupled to the drain of the driving transistor of a corresponding one of the at least two LED driving modules for obtaining the drain voltages;

(ii) a reference voltage input end coupled to the reference voltage generator for receiving the reference voltage; and (iii) a regulation signal output end for outputting the regulation signal to the controller, wherein the regulation signal is the result from the comparison by the drain voltage comparator between the drain voltages and the reference voltage.

3. The LED driving circuit as claimed in claim 2, wherein the reference voltage generated by the reference voltage generator is predetermined as the lowest drain voltage that makes the driving transistor work into a saturation region.

4. The LED driving circuit as claimed in claim 2, wherein when one of the drain voltages is lower than the reference voltage, the controller outputs a control signal to the voltage source according to the regulation signal, such that the voltage outputted from the voltage source is added.

5. The LED driving circuit as claimed in claim 2, wherein each of the at least two drain voltage input end is coupled to a gate of a first transistor; wherein the reference voltage input end is coupled to a gate of a second transistor; wherein the regulation signal is a drain voltage of a drain of the first transistor.

6. The LED driving circuit as claimed in claim 5, wherein the regulation signal is provided by an output of an OR gate, wherein the OR gate comprises at least one input end coupled to the drain of the first transistor for inputting the drain voltage of the drain of the first transistor, and wherein the at least one voltage regulating module further includes an inverter which is coupled to the regulation signal for inverting the regulation signal.

7. The LED driving circuit as claimed in claim 6, the voltage regulating module further comprises:

a double input OR gate having a first input end, a second input end and a output end;

wherein the first input end coupled to the output of the inverter of the voltage regulating module;

wherein the second input end coupled to the output of another double input OR gate of another voltage regulating module; and wherein the output end coupled to the controller.

8. The LED driving circuit as claimed in claim 2, wherein each of the operational amplifiers in the at least each of the two LED driving modules further comprises an output coupled to a gate of the driving transistor.

9. The LED driving circuit as claimed in claim 2, wherein the voltage source is a DC to DC voltage converter.

10. A light emitting diode (LED) driving and regulating system, comprising:

a voltage source providing a first voltage to a plurality sets of LED series, each set of LED series comprises at least two LED series;

a plurality of LED driving circuits, each LED driving circuit drives a corresponding set of the plurality sets of LED series; and a controller coupled to the voltage source for sending a control signal to the voltage source to regulate the first voltage provided to the plurality sets of LED series;

wherein the plurality of the LED driving circuits are coupled in series, and the LED driving circuits of one stage receives and processes the output signal from the LED driving circuits of a previous stage to provide an output signal; and wherein the plurality of LED driving circuits of the last stage send output signals to the controller for regulating the first voltage of the plurality sets of LED series, wherein the plurality of LED driving circuits each comprises:

at least two LED driving modules comprising:

a driving transistor having a drain connected to a first end of a corresponding LED series of the corresponding set of LED series; and an operational amplifier comprising a negative input end connected to a source of the driving transistor and a positive input end coupled to a driving voltage, wherein second ends of the corresponding set of LED series is provided with a first voltage from a voltage source, and the positive input ends of the operational amplifiers of the at least two LED driving modules are connected to the driving voltage together; and a voltage regulating module, coupled to the at least two LED driving modules, for providing a regulation signal to a controller according to drain voltages at the drains of the driving transistors in the at least two LED driving modules such that the controller regulates the first voltage provided at the second end of the at least one LED series according to the regulation signal.

* * * * *